US008490978B2

(12) United States Patent
Rogers

(10) Patent No.: US 8,490,978 B2
(45) Date of Patent: Jul. 23, 2013

(54) BIFACIAL TARGETS, METHODS OF MAKING AND METHODS OF USE

(76) Inventor: Mike Rogers, Clarkston, WA (US)

( * ) Notice: Subject to any disclaimer, the term of this patent is extended or adjusted under 35 U.S.C. 154(b) by 303 days.

(21) Appl. No.: 13/083,747

(22) Filed: Apr. 11, 2011

(65) Prior Publication Data

US 2012/0256372 A1 Oct. 11, 2012

(51) Int. Cl.
*F41J 7/00* (2006.01)

(52) U.S. Cl.
USPC ..... 273/392; 273/406

(58) Field of Classification Search
USPC ..... 273/390–392, 403–410
See application file for complete search history.

(56) References Cited

U.S. PATENT DOCUMENTS

| | | | | |
|---|---|---|---|---|
| 1,030,554 | A * | 6/1912 | Wharton | 273/146 |
| 1,424,632 | A * | 8/1922 | Cecil | 273/392 |
| 1,507,296 | A * | 9/1924 | Dumpe | 273/369 |
| 1,537,738 | A * | 5/1925 | Bisbing | 273/390 |
| 2,039,552 | A * | 5/1936 | Reynolds | 273/391 |
| 2,153,260 | A * | 4/1939 | Edward | 473/389 |
| 2,967,712 | A * | 1/1961 | Breitenfeldt | 273/388 |
| 4,093,227 | A * | 6/1978 | Saunders et al. | 273/388 |
| 4,283,060 | A * | 8/1981 | Braunschweiler | 273/383 |
| 4,309,038 | A * | 1/1982 | Spoon | 473/596 |
| 6,896,267 | B1 * | 5/2005 | Le Anna | 273/391 |
| 7,114,725 | B2 * | 10/2006 | Camp et al. | 273/390 |
| 7,134,977 | B2 * | 11/2006 | Campbell et al. | 473/454 |
| 7,175,181 | B1 * | 2/2007 | Bateman et al. | 273/392 |
| 7,448,967 | B1 * | 11/2008 | Panneri et al. | 473/387 |
| 7,766,338 | B1 * | 8/2010 | Adler et al. | 273/407 |
| 8,413,991 | B2 * | 4/2013 | Sudbeck et al. | 273/392 |
| 2004/0201172 | A1 * | 10/2004 | Goldsmith | 273/391 |
| 2011/0062668 | A1 * | 3/2011 | Leimberer | 273/407 |
| 2011/0163504 | A1 * | 7/2011 | Berger et al. | 273/386 |
| 2012/0025468 | A1 * | 2/2012 | Kreiman et al. | 273/386 |

OTHER PUBLICATIONS

B&B Steel Targets LLC 2010, "Impact Rolling Steel Targets", Web page www.rollingsteeltargets.com, downloaded Mar. 30, 2011.

* cited by examiner

*Primary Examiner* — Mark Graham
(74) *Attorney, Agent, or Firm* — Wells St. John P.S.

(57) ABSTRACT

Targets including bifacial target areas adjoining four planar extension arms that meet at a center and are set at angles of 109.5 degrees between adjacent arms. A method including providing a pair of symmetrical target portions each having two bifacial target areas adjoining extension arms that meet along a centerline. Slits are provided at centerline apexes, and the slits the two portions are merged. The two target portions are welded together along the merged slits. A method including positioning a target on a surface, with one extension arm projecting upward. A firearm is aimed at a face of the bifacial target area adjoined to the upwardly projecting arm. The firearm is fired to impact the face, the impact causing the target to flip into a new position The firearm is then aimed at a face of the bifacial target area adjoined to the new upwardly projecting extension arm.

14 Claims, 5 Drawing Sheets

BIFACIAL TARGETS, METHODS OF MAKING AND METHODS OF USE

TECHNICAL FIELD

The invention pertains to targets for use with firearms, methods of making targets of the invention and methods of utilizing the targets of the invention.

BACKGROUND OF THE INVENTION

Targets for use with firearms are popular for target shooting and for sighting in weapons. A variety of target types are available. Many of the targets available are destroyed during use. Other types of targets need to be reset or repositioned manually during use. It would be advantageous to develop alternative targets for use with firearms.

SUMMARY OF THE INVENTION

In one aspect, the invention encompasses targets for use with firearms. The targets include four bifacial, shaped target areas each adjoining one of four planar extension arms. The four planar extension arms meet at a common center with the extension arms being set at equivalent fixed angles of 109.5 degrees between adjacent arms.

In one aspect, the invention encompasses a method of making a firearm target. The method includes providing a pair of symmetrical target portions each having two bifacial target areas. Each of the two bifacial target areas adjoins individual first and second extension arms that meet along a centerline of the symmetrical target portion. A slit is provided at an apex along the centerline of each of the two symmetrical target portions and the slit of one of the portions is inserted into the slit of the other portion. The two target portions are welded together along the adjoining slits.

In one aspect, the invention encompasses a method of utilizing a target of the invention. The method includes providing a target having four bifacial target areas each adjoined to one of four distinct extension arms, the four extension arms meeting at a target center and forming equivalent angles of 109.5 degrees between adjacent extension arms. The target is positioned on a ground surface with first, second and third extension arms projecting downward and a fourth extension arm projecting upward. A firearm is aimed at a front face of the bifacial target area adjoined to the fourth extension arm. The firearm is fired to impact the front face, the impact causing the target to flip into a new position with one of the first, second and third extension arms projecting upward. The firearm is then aimed at a front face of the bifacial target area adjoined to the new upwardly projecting extension arm.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

In general, the invention encompasses firearms targets that reposition themselves upon impact and are ready for additional use without resetting or manual repositioning of the target. The invention additionally encompasses methodology for making targets of the invention and methodology for utilizing targets of the invention. The invention is described generally with reference to FIGS. 1-6.

Figure 1:
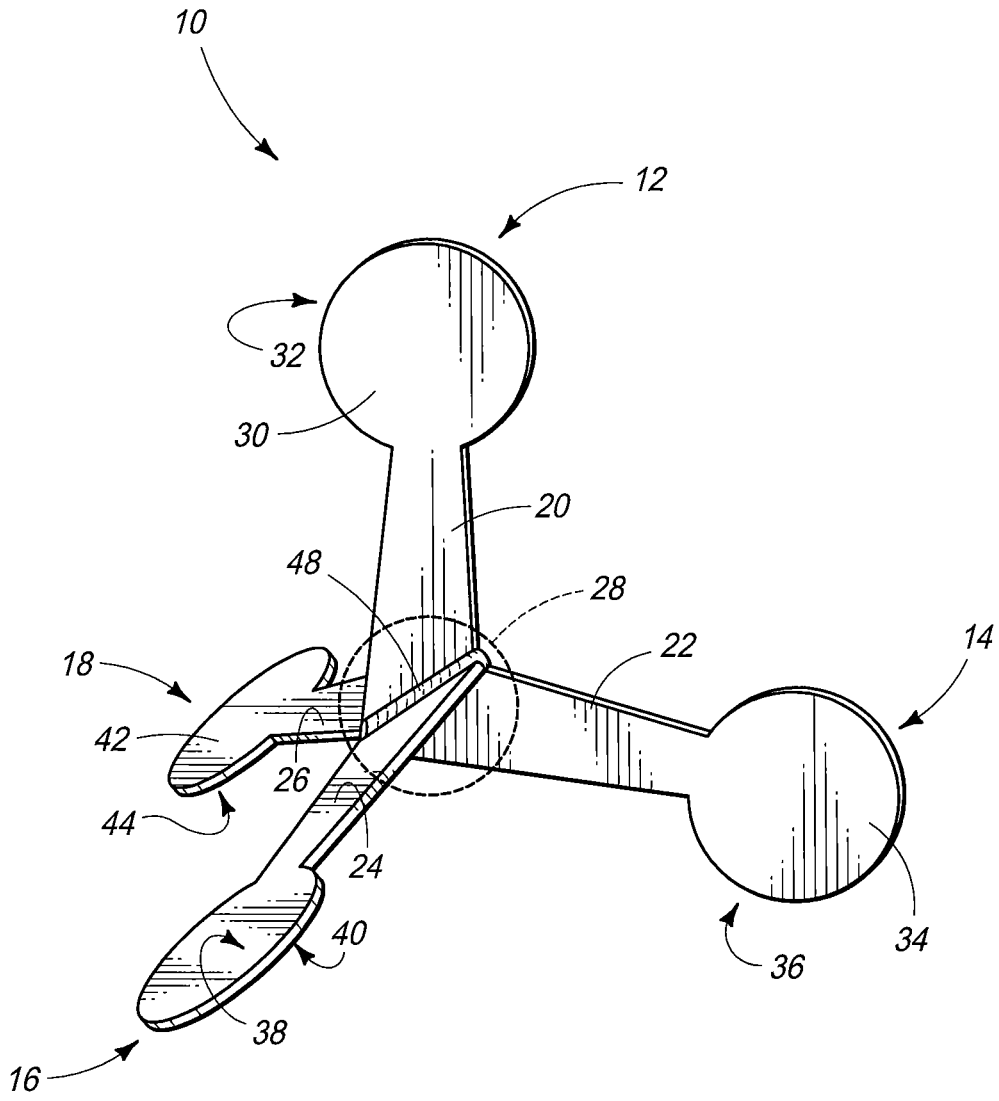
FIG. 1 is a diagrammatic representation of an example target in accordance with one aspect of the invention.

Referring initially to FIG. 1, an example target 10 in accordance with one embodiment of the invention is depicted. The target comprises four bifacial, shaped target areas 12, 14, 16, 18. The bifacial, shaped target areas of the target are configured to be double-sided target surfaces that are the surfaces that make up the portion of the target at which the firearm is aimed. The four target areas 12, 14, 16 and 18 each comprise a first (front) side 30, 34, 38 and 42, and a corresponding second side (back) 32, 36, 40 and 44 and are preferably planar.

As depicted in FIG. 1, the shaped target areas can be solid circular shaped. However, it is to be understood that the invention encompasses alternatively shaped target areas. Alternative target area shapes can include, for example, squares, diamonds, triangles, ovals, rectangles, octagons or other polygons, and animal silhouettes.

Each bifacial target area 12, 14, 16 and 18 is adjoined to one of four extension arms 20, 22, 24 and 26. The four extension arms are preferably planar as depicted in FIG. 1. Extension arms 20, 22, 24 and 26 meet at a common center 28, which is the center of the target structure 10. The arms can be joined at the center by welding 48. The arms can be formed individually of each other or can preferably be formed in pairs (discussed below).

Target 10 can be formed from a variety of materials. The material chosen is preferably strong enough to withstand the impact from a bullet of the caliber of firearm being utilized with the target. Example materials for target 10 can include aluminum alloys, steels, stainless steel, armor plate, ceramics, composite materials, synthetic materials and laminates. Where the target areas are formed independently of the extension arms (see below), differing materials can be utilized for each portion as long as compatible materials are chosen that can be joined in a sufficiently strong manner to withstand firing impact.

Figure 2:
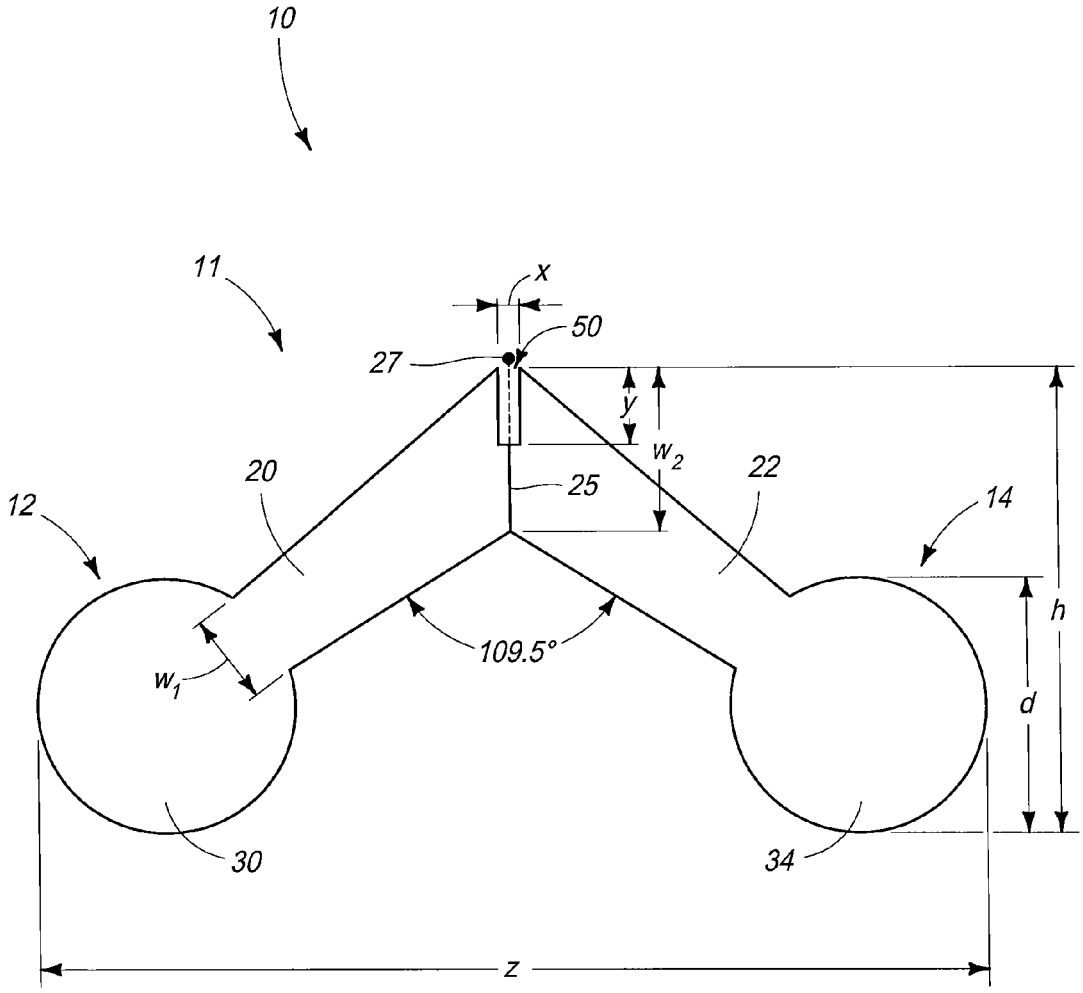
FIG. 2 is a diagrammatic representation of a unitary portion of the target depicted in FIG. 1, in accordance with one aspect of the invention.

Referring to FIG. 2, a symmetrical target portion 11 is diagrammatically illustrated. Such is in accordance with one embodiment of the invention. Symmetrical target portion 11 comprises two bifacial target areas 12, 14 and two corresponding adjoining extension arms 20, 22. Extension arms 20 and 22 meet along a centerline 25 of the symmetrical target portion. Symmetrical target portion 11 is cut or formed from a single piece of material.

As illustrated in FIG. 2, the extension arms of the target can be tapered such that the arms become narrower toward the adjoining bifacial target areas. Preferably, the width of the arm remains sufficiently wide to prevent bending of the target upon impact or due to multiple impacts over time. As shown in the figure, the angle formed between extension arms 20 and 22 is 109.5 degrees. The invention contemplates use of alternative angles between the extension arms.

A central slit 50 can be provided at an apex 27 along centerline 25 of symmetrical target portion 11.

In accordance with one embodiment of the invention, methodology of forming a target in accordance with the invention includes providing two symmetrical target portions 11 as depicted in FIG. 2 and inserting the slits of each of the two portions into each other to merge the slits and overlap each slit onto the centerline of the opposing symmetrical target portion to form a single target unit 10 as depicted in FIG. 1. The two symmetrical target portions are welded together by forming welds along the overlapping regions.

Once the two symmetrical target portions are joined to form a unitary target 10, such as illustrated in FIG. 1, the angles between each pair of adjacent extension arms is 109.5 degree.

In an alternative aspect, each of the four extension arms and adjoining bifacial target areas can be formed as individual parts (not shown). The four separate extension arms can be joined at a common center to form the center of the target and can be welded together to bond the individual parts into a unitary target such as that depicted in FIG. 1. Alternative joining methods are also contemplated including mechanical fastening, epoxy or alternative adhesives, etc. Such alternative joining methods can be especially useful for embodiments comprising materials other than steel or weldable metals, alloys and composites. Further, the targets of the invention can be fabricated by molding as a single unitary piece.

Target 10 depicted in FIG. 1 is not limited to any particular size. The target size can be dependent upon the caliber of firearm being utilized. For example, the target can be miniaturized to an overall height of as small as 3 inches or can be scaled up to an overall height of six feet. Accordingly, targets of the invention can be utilized for firearms as small as BB guns or pellet guns, up to large caliber rifles and handguns.

It is additionally to be understood that scaling of various areas of the targets of the invention can be disproportionate. For example, the bifacial target areas can be made larger or smaller relative to the extension arms as compared to the embodiment depicted in FIGS. 1 and 2.

Referring again to FIGS. 1 and 2, in one particular example, target 10 can comprise bifacial, shaped target areas 12, 14 16 and 19 that are circular and have a diameter "d" of 2.75 inches. An example distance "z" between outer edges of adjacent bifacial target areas can be 10.5 inches. A width "$w_1$" of the extension arms at a position adjoining the bifacial target area can be 1.00 inch. A width "$w_2$" of the extension arm at centerline 25 can be 2.00 inches.

In the example target having the above dimensions, slit 50 can have a length "y" of 1.00 inch, and a width "x" of 0.200 inches. An overall height "h" of symmetrical target portion 11, measured from apex 27 to the bottom of the bifacial target areas, is 5.375 inches. This target can be made of, for example 3/16 inch, A36 steel and can be configured for utilization with 22 long rifle firearms.

Figure 3:
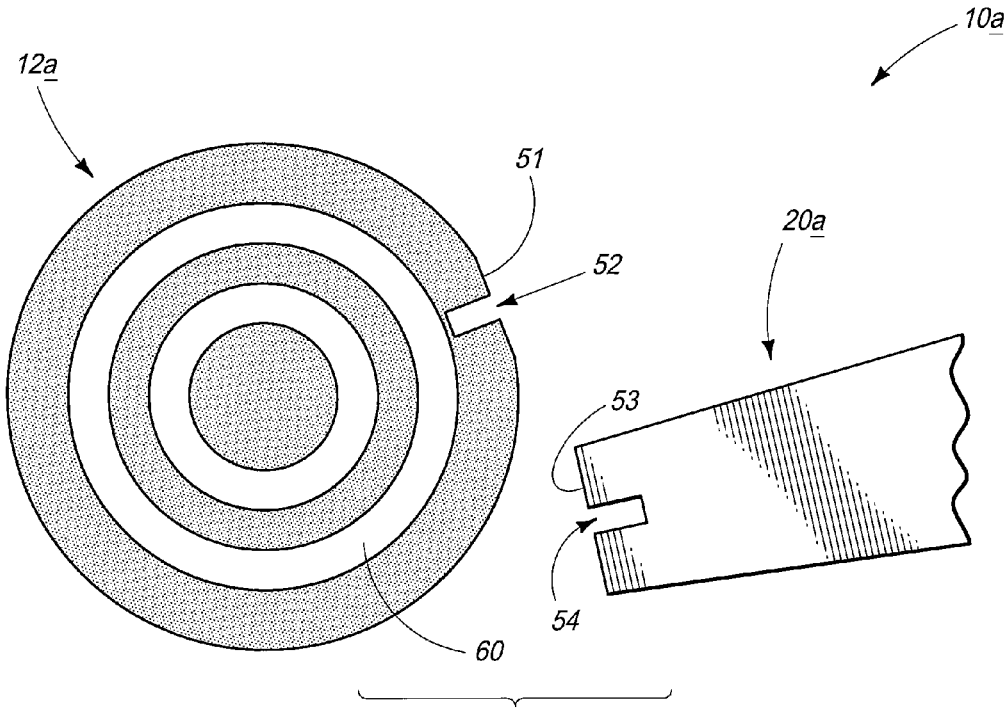
FIG. 3 is a diagrammatic fragmentary representation of target portions at an initial processing stage in accordance with an alternative embodiment of the invention.

As shown in FIGS. 1 and 2, target 10 can comprise bifacial target areas and adjoining extension arms that are coplanar. In alternative embodiments, the invention contemplates bifacial target areas and adjoining extension arms that are adjoined at alternative angles. Referring to FIG. 3, such depicts example target components with features analogous to those in FIG. 1 numbered the same the analogous feature in FIG. 1 with the added identifier "A". New features are assigned unique identifiers.

As shown in FIG. 3, bifacial target area 12A can be formed as a distinct component relative to extension arm 20A. Bifacial target area 12A can be prepared for joining with extension arm 20A by formation of a notch 52 along an outer edge 51 of the separately formed bifacial target area. Extension arm 20A can be prepared for joining with bifacial target area 12A by forming a notch 54 along a distal end 53 (as measured from the target center) of the extension arm. It is to be understood that notches 52 and 54 are optional and that joining of extension arm 20A and bifacial target area 12A can be performed utilizing only one of the notches or an absence of notches.

Feature 60 depicted in FIG. 3 is a bull's eye pattern on a surface of target area 12A. Such can be achieved by painting or application of a decal to the surface. Such feature is optional and can be present on some or all faces of the bifacial target areas of any of the embodiments of the invention. Alternative patterns, solid colors and silhouette decal or painting patterns are contemplated.

Figure 4:
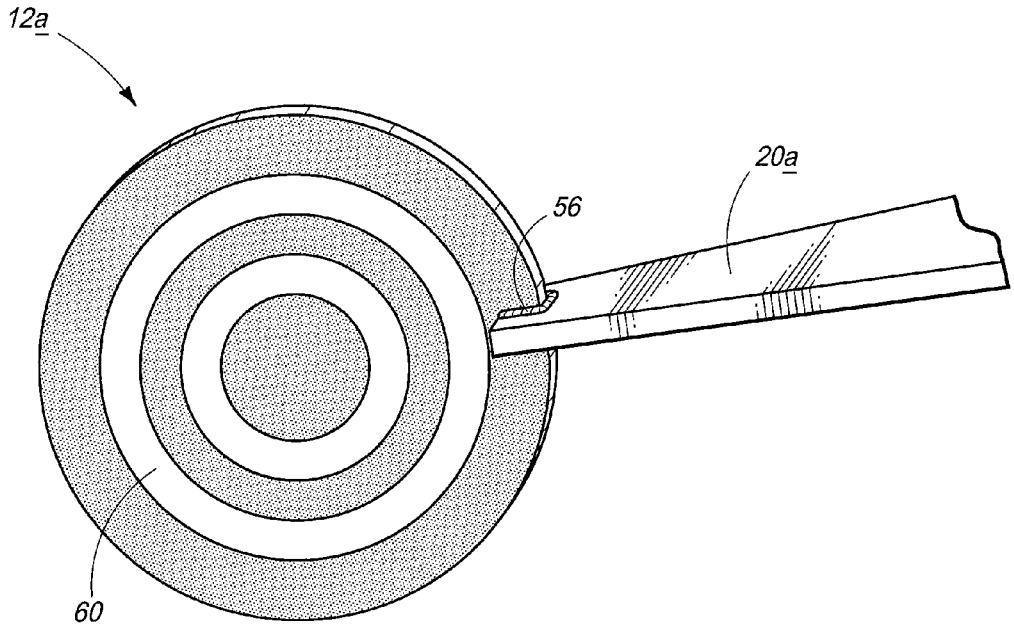
FIG. 4 is a diagrammatic fragmentary representation of the target portions depicted in FIG. 3 at a processing stage subsequent to that depicted in FIG. 3.

Referring to FIG. 4, bifacial target area 12A and extension arm 20A have been joined by insertion of the two notches 52 and 54 into one another and overlapping notch 52 onto extension arm 20A. The two parts are then fixed by welding 56 the overlapping areas. As shown, bifacial target area 12A and extension arm 20 A can be joined at a 90 degree angle relative to one another. Alternative angles are contemplated. It can be advantageous to join the bifacial target areas to the extension arms at 90-degree angles for added strength and to prevent bending over of the target area by repeated impact.

The extension arm 20A depicted in FIGS. 3 and 4 can be part of a pair of extension arms (not shown) comprised by a symmetrical target portion analogous to that depicted in FIG. 2 but lacking the adjoining bifacial target areas. Two such symmetrical target portions can be joined as described above. Alternatively, each of the four extension arms (lacking adjoining target areas) can be formed individually and joined to form a common target center. The attachment of the bifacial target areas to the extension arms can be performed before or after joining of the extension arms to form the target center.

Figure 5:
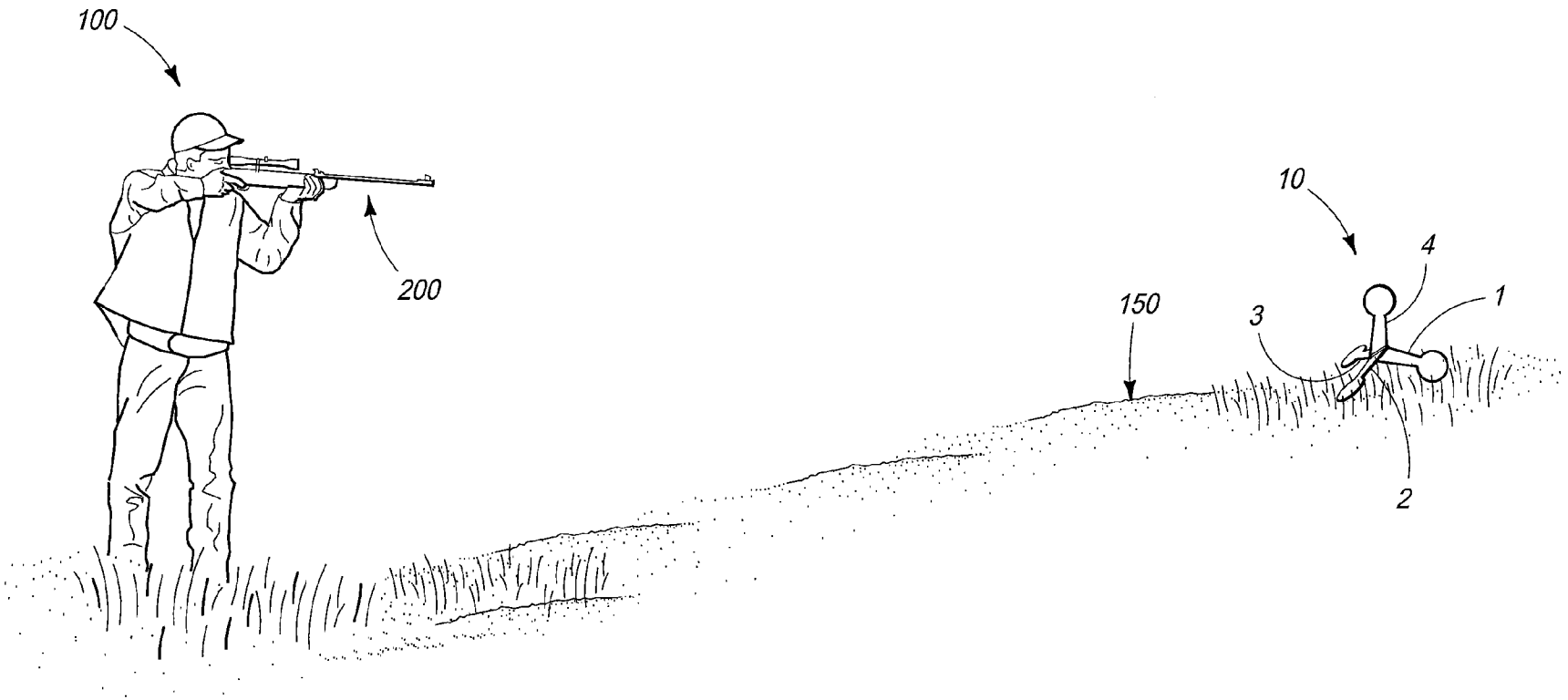
FIG. 5 is a diagrammatic representation of an initial stage of target use in accordance with one aspect of the invention.

A method of using a target in accordance with the invention is described with reference to FIGS. 5-6. Referring initially to FIG. 5, a shooter 100 is illustrated utilizing a target 10. Target 10 is positioned on a ground surface 150 in an initial position having a first extension arm 2, a second extension arm 3 and a third extension arm 4 projecting downward from the target center. A fourth extension arm 1 extends upward. A firearm 200, which can be for example, a rifle or a handgun, is aimed at a front face of the bifacial target area adjoining upwardly projecting extension arm 1. Firearm 200 is fired to impact the front face of the targeted bifacial target area.

Figure 6:
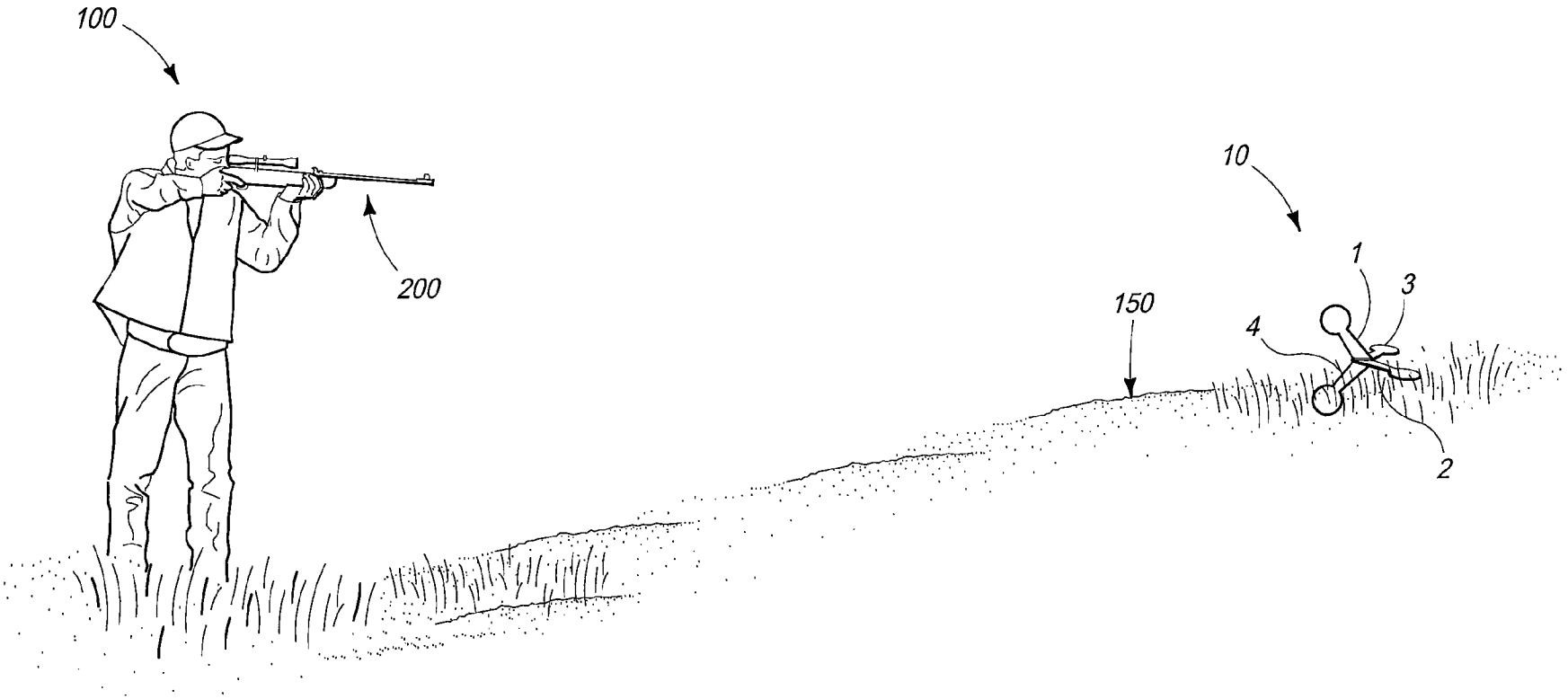
FIG. 6 is a diagrammatic representation of a stage of target use subsequent to that depicted in FIG. 5.

Referring to FIG. 6, upon impact, target 10 flips into a new position with a new, different extension arm 4 projecting upward. Extension arms 1, 2 and 3 project downward from the target center and support the target on ground surface 150. The firearm is then aimed at a front face of a bifacial target area adjoining upwardly projecting extension arm 4.

The targets of the invention allow repeated firing at the target without any manual resetting or repositioning. The targets do not get destroyed during use and have extremely long lifetimes. Further, the bifacial target area configuration affords greater target strength for longer target life relative to alternative target area configurations. Similarly, the planar configuration of the extension arms inhibits or prevents bowing, twisting or bending of the arm or the joint area between the arm and the target area due to repeated impact, which may occur with alternative configurations such as hollow or solid rod shaped extension arms.

The planar configuration of the bifacial target areas is also easier to sight on and to aim at relative to contoured target faces and are more conducive to decal placement or painting of designs such as silhouettes. The planar configuration is also advantageous in allowing alternative target area shapes including silhouettes.

As described above, the overall configuration of the targets of the invention is ideal for scaling for use with various size handguns and rifles. Accordingly, the targets of the invention can be adapted for various calibers, which is a feature not afforded by other impact targets.

Another advantage of the configuration of the targets of the invention is the minimization of joining areas. The ability to utilize pairs of symmetrical target portions as described above, minimizes the number of welds or other joining techniques utilized in alternative devices. This feature affords maximized target strength, longer target life and ease in fabrication.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A target for use with firearms, the target comprising:

four bifacial, shaped target areas; and four planar extension arms, each of the individual extension arms adjoining one of the bifacial, shaped target areas, the four extension arms joining at a common center and being set at equivalent fixed angles of 109.5 degrees between adjacent extension arms;

wherein the target consists of two joined symmetrical portions, each symmetrical portion containing two of the extension arms, the symmetrical portions each comprising a central slit at an apex where the two extension arms meet, the two joined symmetrical portions being joined by insertion of a first central slit of a first symmetrical portion into a second central slit of a second symmetrical portion such that the slits overlap centerlines of opposing symmetrical portions and welding the two symmetrical portions along overlapping regions.

2. The target of claim 1 wherein when placed upon a ground surface, a first, second and third of the four extension arms project downward to support the target and a forth extension arm projects upward, the bifacial, shaped target area adjoined to the upward projecting extension arm being an initial target area.

3. The target of claim 2 wherein upon impact of a bullet with the initial target area, the target flips to a new position such that one of the first, second or third extension arms project upward and the corresponding adjoined bifacial shaped target area is the new present target area.

4. The target of claim 1 wherein each extension arm has a width that tapers toward the adjoining bifacial, shaped target area.

5. The target of claim 1 wherein the bifacial, shaped target areas are solid circular shaped.

6. The target of claim 5 wherein the target has a distance measurement from the outer edge of a first circular target area to the outer edge of a second circular target area of 10.5 inches.

7. The target of claim 5 wherein the circular shaped bifacial target areas have a 2.75 inch diameter.

8. The target of claim 1 wherein the extension arms are coplanar with their adjoining bifacial, shaped target area.

9. The target of claim 1 wherein the bifacial, shaped target areas are rotated 90 degrees relative to the planarity of the adjoining extension arm.

10. The target of claim 1 wherein the target comprises one or more materials selected from the group consisting of aluminum alloys, steel, stainless steel, armor plate, ceramics, composite materials, synthetic materials and laminate materials.

11. The target of claim 1 wherein the shaped target areas comprise a shape selected from the group consisting of square, diamond, triangular, oval, rectangular, octagon or other polygon, and animal silhouettes.

12. The target of claim 1 wherein the target comprises 3/16 inch thick A36 steel.

13. The target of claim 1 wherein the overall height of the target is from 3 inches to about 6 feet.

14. The target of claim 1 further comprising painted or decal surfaces on the bifacial, shaped target areas.

* * * * *

UNITED STATES PATENT AND TRADEMARK OFFICE

CERTIFICATE OF CORRECTION

PATENT NO. : 8,490,978 B2
APPLICATION NO. : 13/083747
DATED : July 23, 2013
INVENTOR(S) : Mike Rogers It is certified that error appears in the above-identified patent and that said Letters Patent is hereby corrected as shown below:

On the Title Page:

Item (57) Abstract – Replace "position The" with --position. The--

In the Specifications:

Column 3, line 21 – Replace "degree." with --degrees.--

In the Claims:

Column 6, in Claim 2, line 6 – Replace "and a forth" with --and a fourth--

Signed and Sealed this
Seventeenth Day of September, 2013

Teresa Stanek Rea

Teresa Stanek Rea
*Deputy Director of the United States Patent and Trademark Office*